US006135296A

United States Patent [19]

Colgrove

[11] Patent Number: 6,135,296

[45] Date of Patent: Oct. 24, 2000

[54] CUP HOLDER

[76] Inventor: Mark R. Colgrove, 310 Cherry St., Oxford, N.C. 27565

[21] Appl. No.: 09/430,577

[22] Filed: Oct. 29, 1999

[51] Int. Cl.[7] ..... A47G 19/08

[52] U.S. Cl. ..... 211/41.8

[58] Field of Search ..... 211/41.8, 74; 206/217, 206/565; 134/201

[56] References Cited

U.S. PATENT DOCUMENTS

| | | | |
|---|---|---|---|
| 697,247 | 4/1902 | Harris . | |
| 1,156,319 | 10/1915 | Schaub . | |
| 1,257,902 | 2/1918 | McCullough . | |
| 1,285,000 | 11/1918 | Blakeslee | 211/41.8 |
| 1,371,253 | 3/1921 | Lynch . | |
| 2,741,392 | 4/1956 | Weiss | 211/74 |
| 2,970,700 | 2/1961 | Lacy et al. . | |
| 3,141,552 | 7/1964 | Ettlinger, Jr. | 211/41.8 |
| 3,163,320 | 12/1964 | Monk . | |
| 3,217,890 | 11/1965 | Maslow | 211/41.8 |
| 3,442,397 | 5/1969 | Jaffee et al. . | |
| 3,643,812 | 2/1972 | Mander et al. | 211/74 |
| 4,498,594 | 2/1985 | Elder . | |
| 4,512,489 | 4/1985 | Green et al. . | |
| 4,527,707 | 7/1985 | Heymann et al. | 211/41.8 |
| 4,621,739 | 11/1986 | Heymann et al. | 211/74 |
| 4,732,291 | 3/1988 | McConnell . | |
| 4,947,991 | 8/1990 | Snell | 211/74 |

*Primary Examiner*—Alvin Chin-Shue
*Assistant Examiner*—Sarah Purol
*Attorney, Agent, or Firm*—Olive & Olive, P.A.

[57] ABSTRACT

A cup holder for securely holding multiple tapered cups within, and for mounting within an automatic dishwasher. A first plate contains apertures extending therethrough. The apertures are large enough to allow passage of the small bottom ends of tapered cups but small enough to prohibit passage of the relatively larger top ends of the cups. The first plate is supported by legs attached to its underside, such that the bottoms of the cups do not touch the surface upon which the legs rest. The cups are trapped between the first and second plates. The second plate is latched to the first plate by a plurality of extendable arms. Extendable arms are extendable beyond the ends of the cup holder and are mountable upon horizontal members in the upstanding sides of utensil racks provided and used in various styles and makes of automatic dishwashers. Indentations in the upper face of the top gridwork are provided to receive the bottoms of the legs, which support the bottom gridwork and thereby facilitate secure stacking of multiple racks for storage purposes. The cup holder is set into the dishwasher with the open tops of the cups facing downward.

13 Claims, 7 Drawing Sheets

CUP HOLDER

FIELD OF THE INVENTION

The present invention relates to a device used to hold cups in an automatic dishwasher. More specifically, the present invention relates to a cup holder that holds cups having tapered sides with a smaller diameter at the bottom than at the top end of the cups, and sized to fit within an attractive serving tray for use during communion services.

BACKGROUND OF THE INVENTION

Many Christian churches hold regular communion services in which small portions of bread and small cups filled with juice or wine are served. The cups predominantly used for these services have tapered sides with the bottom of the cups having a smaller diameter than the top, thereby facilitating a simple means by which the congregation can dispense of the cups after they have drunk the contents. Typically, each individual dispenses their cup by placing it in one of several, generally vertical, holes that pass through one or more horizontal members affixed to the backs of the church pews. After the service, someone retrieves the empty cups.

Prior to the proliferation of plastic, glass was the dominant material out of which communion cups were made. To avoid the laborious and time consuming task of hand washing numerous small cups following a communion service, many congregations have now use plastic cups that are simply thrown away after the service. While plastic cups eliminate the laborious task of hand washing, for some people plastic cups tend to cheapen communion services. Additionally, throwaway plastic is blatantly unfriendly towards the environment. Many people associate a disregard for the environment with sinfulness, and therefore find considerable objection to using throw away plastic cups for a communion service. Members of a church congregation who find objection to plastic communion cups are often those who volunteer to hand wash the glass cups.

While plastic has become very prevalent, so have automatic dishwashers. Many church congregations today have dishwashers at their place of worship, or have access to a dishwasher via members of the congregation. The current invention is sized and equipped to perform in every commercially available dishwasher currently known to the inventor. In addition to facilitating fast and easy washing of glass cups, the current invention can also be used as a storage rack, and as a serving tray. By using the current invention in all of its capacities, even less handling of the individual cups is required than is required when using disposable cups.

There are other known devices that hold drinking cups and other small items for use in automatic dishwashers. However, none of these devices are well adapted to being set into the varying sizes and configurations of wire racks found in virtually all dishwasher racks intended for residential use. These devices offer no provisions for safely mounting them to a wire form dishwasher rack such that the coating on the wires of the racks would not be damaged in the process. Previous devices are also significantly more costly to produce in small quantities due to the increased number of operations and types of equipment required to produce wire formed objects, and due to the initial costs of the molds that are required for injection type molding of multiple parts. Delaire presents a device made from extruded parts which offer a cost effective means of production, however, this device as presented is not adapted for washing purposes and certainly no suggestion is apparent for how such a device might be installed into a variety of dishwasher racks without harming the coatings on the wires, especially at the tip ends of wires which are found in most automatic dishwasher racks. There are also known devices specifically for washing communion cups in a vat of soapy water, where the washer person maintains physical control over the device during the washing.

SUMMARY OF THE INVENTION

The principal object of the current invention is to provide a cup holder for holding a large quantity of tapered cups such that they may be held in a particular orientation in variously sized automatic dishwasher racks.

It is also an object of the present invention to provide a cup holder, which is simple and inexpensive to construct.

Another object of the present invention is to provide a cup holder, which can be made predominantly of parts cut from a single piece of sheet material.

Another object of the invention is to provide a cup holder that may be adjusted to fit both the top and bottom racks of a typical dishwasher designed for residential use.

Another object of the current invention is to provide a cup holder that holds a maximum quantity of cups in any known commercially available dishwasher.

Another object of the current invention is to provide a cup holder having a portion, which may alternately be used as a serving tray for the cups.

Another object of the current invention is to provide a cup holder, which can additionally be used as a rack to safely and efficiently store similarly sized tapered cups.

Another object of the current invention is to provide a cup holder, which may be stacked in multiples as might be desired for storage.

Another object of this invention is to provide a cup holder, which may be made so as to be capable of simultaneously holding at least one of each size and style of known commercially available communion cups.

A final object of this invention is to provide a cup holder, which can be made from readily available and easily cut materials that will withstand the caustic dishwasher environment, yet be tough enough to perform well through repeated uses.

The foregoing objects can be accomplished by providing two flat, rectangular, and similarly sized, plate cut from plastic sheet material and latching means to releasably hold the two plates parallel to one another and at a specific uniform distance apart. A first of the two plates is equipped with four legs, which hold that plate above and parallel to a tabletop or other horizontal surface. The first plate is perforated with apertures sized to receive the small bottom ends of tapered cups and allow only partial passage of the cups through the plate. The second of the two plates is perforated with apertures so as to allow maximum passage of wash water while providing a grid work of material sufficient to prevent passage of the wide diameter tops of the cups. This second plate overlays and is latched to the first plate after the tapered cups to be washed have been set into the apertures in the first plate. Once latched to the first plate, the second plate entraps the cups such that they can not be removed from the first plate. The cup filled device is set horizontally into the dishwasher with the second plate below the first plate so that the open ends of the cups face downward.

To prevent haphazard bearing of the cup holder of the present invention at unpredictable points on the rack of a residential style dishwasher, adjustable support arms retained at each corner of the cup holder are provided to facilitate suspension of the device above the dishwasher rack's multiple upstanding coated wire formations. The adjustable support arms overhang opposite ends of the cup holder and are supported by horizontal members in the upstanding sides of the dishwasher's rack. Each adjustable arm is fastened to the cup holder's second plate. The distance to which each arm overhangs the ends of the cup holder may be changed as needed to cause the device to fit, and be easily used in any currently known and available dishwasher rack. Except for the legs, the first and second surfaces of the device's first plate are free of appendages or protuberances. The sides of the first and second plate are generally straight, smooth, and unobstructed. These characteristics aesthetically facilitate usefulness of the first plate as a serving tray for the cups. Setting the first plate into a simple yet attractive frame further enhances its usefulness as a serving tray. The current invention greatly reduces handling of the cups as it may be used not only to hold cups for washing, but also for serving and for storage.

DETAILED DESCRIPTION OF THE INVENTION

Figure 1:
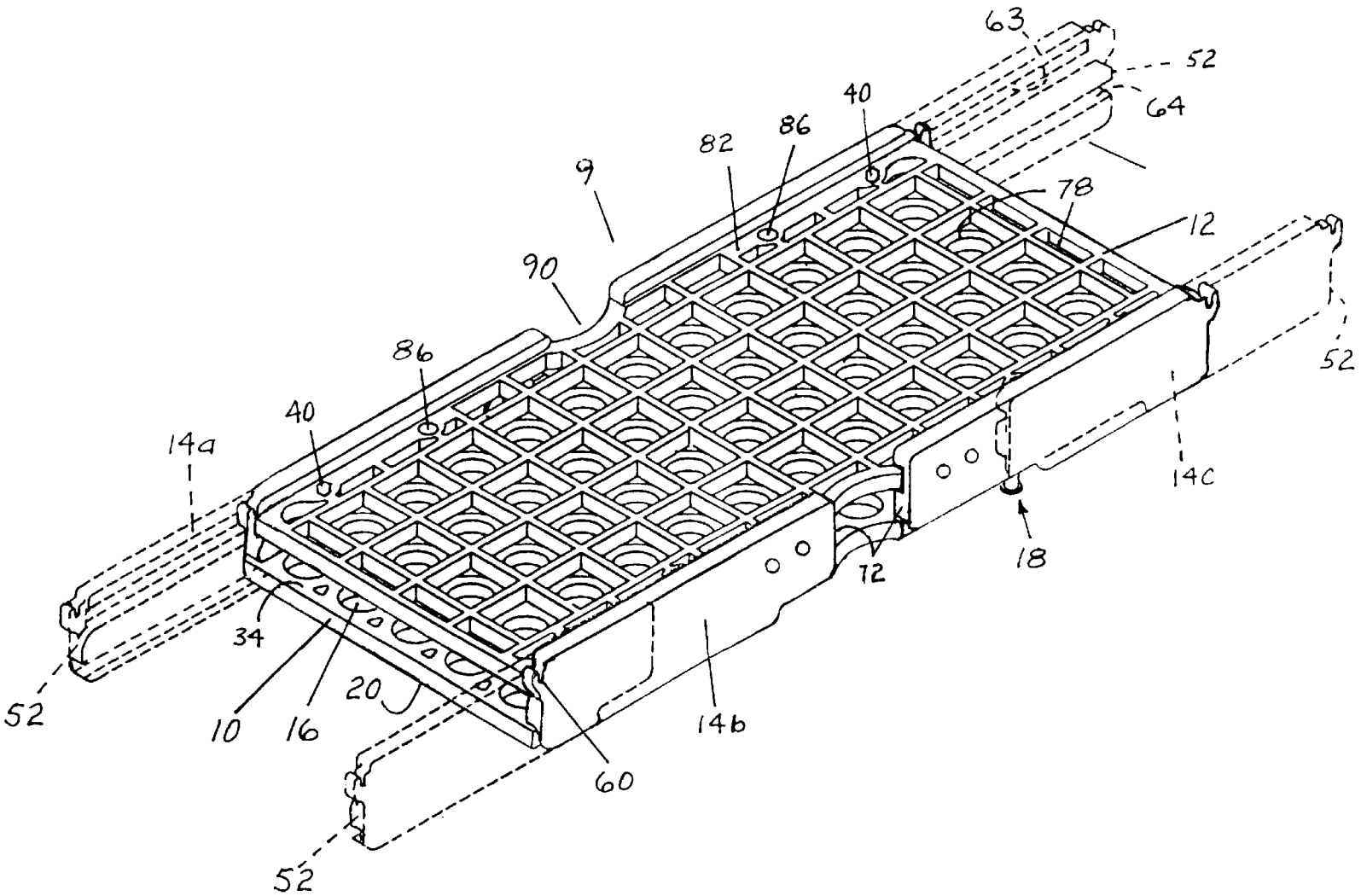
FIG. 1 is an isometric view of a cup holder of the present invention with first and second plates latched together and showing the arms of the invention extended for mounting within an automatic dishwasher.
Figure 4:
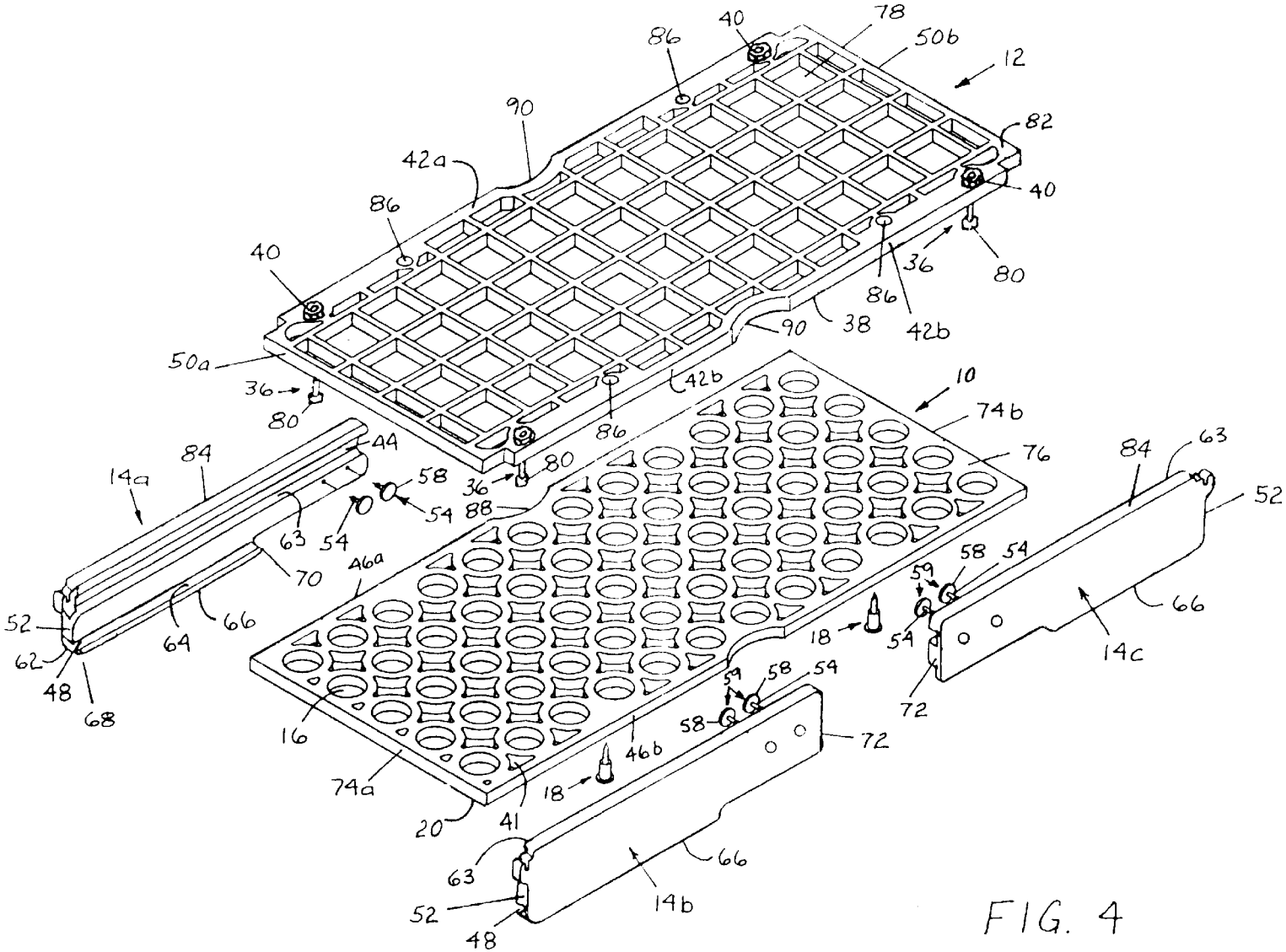
FIG. 4 is an exploded isometric view of the cup holder of the present invention, where, for simplicity, one extendable arm is not shown.

Referring to FIGS. 1 and 4, cup holder 9 of the present invention includes two flat, generally rectangular, and similarly sized, perforated first and second plates 10 and 12, cut from plastic sheet material and including extendable arms 14*a*, 14*b*, 14*c*, 14*d* to releasably latch first and second plates 10 and 12 together and apart a specific uniform distance. When latched together, first and second plates 10 and 12 are parallel and juxtaposed such that the sides and ends, which define the perimeter of first plate 10, are generally aligned with the matching sides and ends that define the perimeter of second plate 12.

Figure 2:
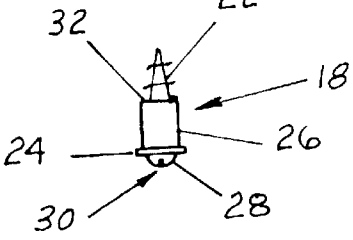
FIG. 2 is an orthogonal view of an individual leg assembly, which supports the cup holder of the inventiion above a table or other support surface.

First plate 10 has spaced apertures 16 extending therethrough, sized to receive the small bottom ends of tapered cups C and allow only partial passage of cups C through first plate 10. In the preferred embodiment of the present invention, the spaced apertures 16 are circular to best fit cups having a circular cross section. Four short leg members 18 are affixed to a first surface 20 of the first plate 10. Referring to FIG. 2, it is seen that each leg 18 is constructed with a self tapping type screw 22, a plastic washer 24, and plastic tube which serves as a standoff 26 to hold the washer 24 against the underside of the screw head 28.

Figure 3:
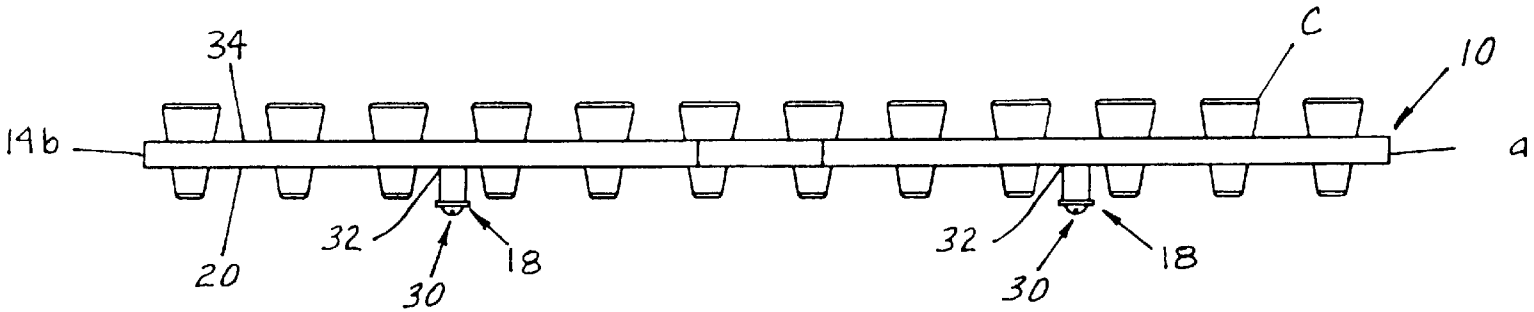
FIG. 3 is an orthogonal view of the first plate of the present invention showing it filled with tapered cups.

Referring to FIGS. 2 and 3, legs 18 have sufficient length to hold first plate 10 above a table, a display box, or other support surface a distance adequate to prevent the bottoms of the cups from touching the table or other support surface. Support ends 30 of each leg 18 rests on a support surface (not shown), with opposed ends 32 of each leg 18 attached to a first surface 20 of first plate 10. The surface opposite the first surface 20 is defined as second surface 34 of first plate 10.

Second plate 12 contains apertures 78 extending therethrough so as to allow wash water to spray and wash cups C mounted within the cup holder of the invention, while providing a grid-work of material sufficient to prevent passage of the cups from cupholder 9. Referring to FIG. 4, four elongate guideposts 36 project from a first surface 38 of second plate 12 adjacent each corner of second plate 12. In the preferred embodiment, guideposts 36 are screws that are anchored at the screw's threaded end to second plate 12 via lock nuts 40 tightened against the surfaces of second plate 12. The exact locations of guideposts 36 are such that when second plate 12 is aligned with and lowered into position over first plate 10, guidepost screw heads 80 enter and are confined by the perimeter of specific apertures 41, sized slightly larger than guidepost screw heads 80. Guideposts 36 initially help the user of the current invention to align second plate 12 properly over first plate 10 when connecting the two together; then once plates 10 and 12 are connected together, guideposts 36 prohibit relative movement of the first and second plates 10 and 12 within their respective planes.

Referring to FIGS. 1, 4, 5, and 7, two, generally rectangular shaped, extendable arms 14*a*, 14*b*, 14*c*, and 14*d* are shown. Extendable arms 14*a*, 14*b*, 14*c*, and 14*d* are slideably attached to each of the long edges or sides 42*a* and 42*b* of second plate 12. The thickness of extendable arms 14*a*, 14*b*, 14*c*, and 14*d*, equals the thickness of first and second plates 10 and 12 and may therefore be cut from the same sheet of material as is first and second plates 10 and 12.

Referring to FIGS. 1 and 4, each extendable arm 14*a*, 14*b*, 14*c*, and 14*d* includes two parallel channels, 44 and 48, which extend along the length of each such arm. Channels 44 and 48 have a width equal to the thickness of first and second plates 10 and 12. Sides 42*a* and 42*b* of second plate 12 are mounted and slide in respective second channels 44 of extendable arms 14*a*, 14*b*, 14*c*, 14*d*, while sides 46*a* and 46*b* of first plate 10 slide in respective first channels 48 of each extendable arm 14*a*, 14*b*, and 14*c*, 14*d*. In the preferred embodiment, the length of arms 14*a*, 14*b*, 14*c*, and 14*d* is slightly less than half of the length of first and second plates 10 and 12, thereby allowing the arms to be placed in a retracted position such that no part extends beyond ends 74*a* and 74*b* and 50*a* and 50*b* of the plate members 10 and 12 respectively. Alternatively, arms 14*a*, 14*b*, 14*c*, and 14*d* are slidable along sides 46*a*, 46*b*, and 42*a*, 42*b* of plates 10 and 12 such that a first end 52 of each arm extends beyond ends 74*a*, 74*b* and 50*a*, 50*b*.

Figure 6:
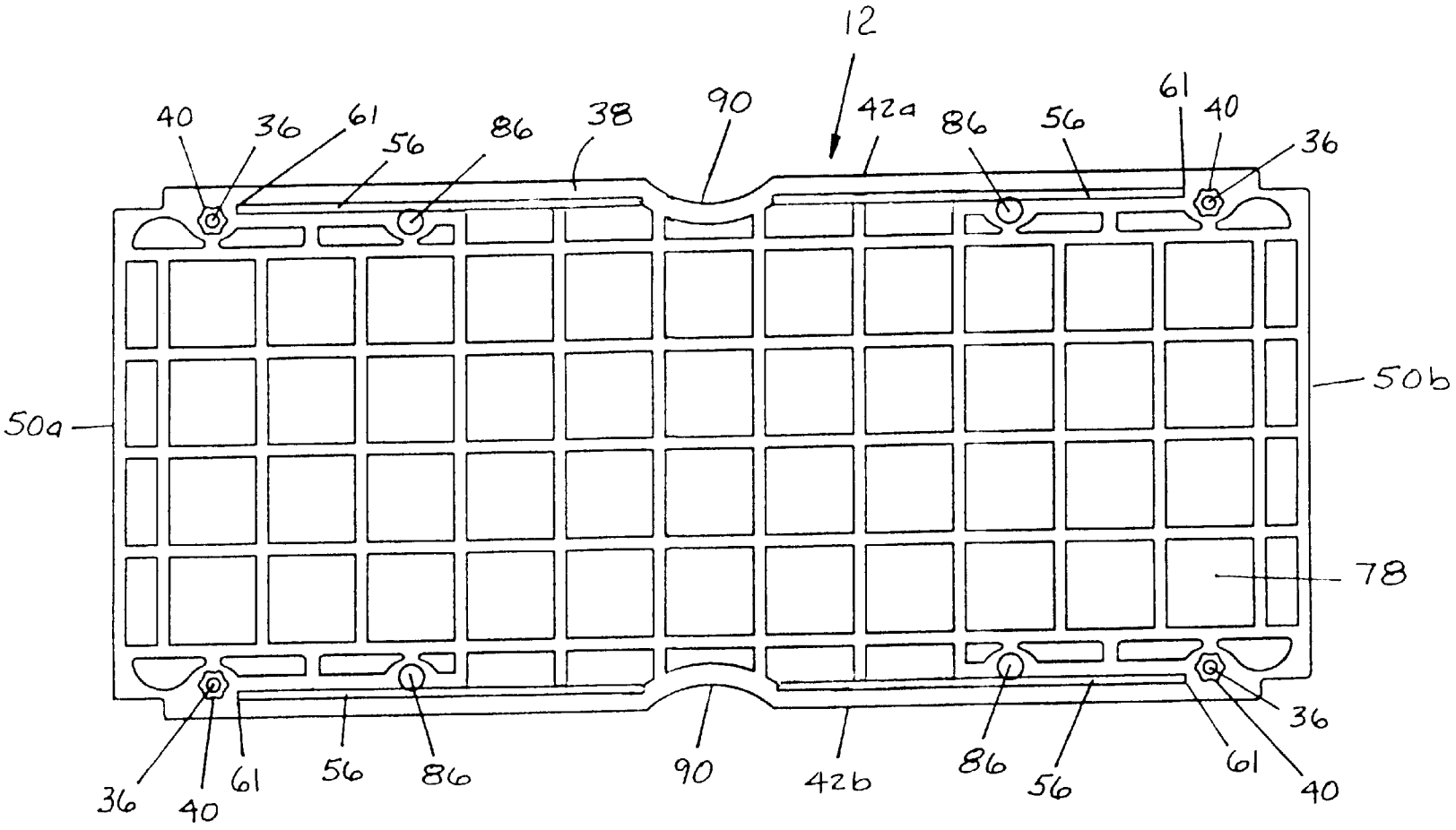
FIG. 6 is an orthogonal view of the second surface of the second plate showing four narrow grooves which facilitate sliding attachment of the extendable arms of the present invention.
Figure 7:
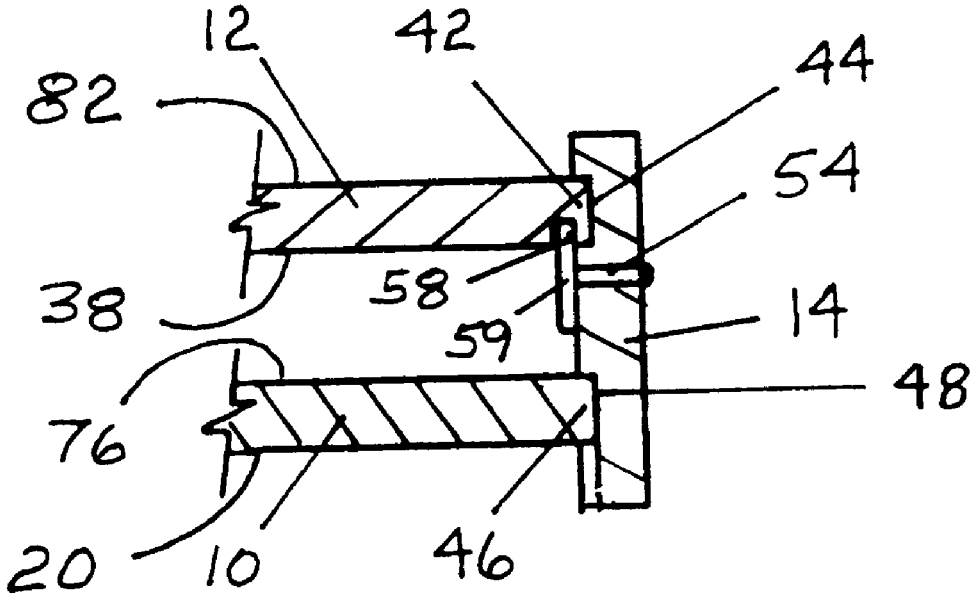
FIG. 7 is a partial sectional view of the extendable arm showing cooperation with first and second plates of the present invention.

Referring to FIGS. 4, 6, and 7, two snap in style retainer pins 54 are attached near to a second end 72 of each extendable arm 14*a*, 14*b*, 14*c*, and 14*d*. Flange 58 of head 59 of each snap-in style retainer pin 54 overhangs a interior sidewall 63 of second channel 44 of each extendable arm 14*a*, 14*b*, 14*c*, and 14*d*, and travels in a narrow groove 56 in first face 38 of second plate 12. Each groove 56 is parallel to the sides of second plate 12. Head 59 of retainer pin 54 provides the connection means attaching arms 14*a*, 14*b*, 14*c*, and 14*d*, to second plate 12 and also enabling arms to slide along sides 42 of second plate. Groove 56 in first surface 38 of second plate 12 terminates a short distance from ends 50*a* and 50*b* of second plate 12. End 61 of each groove 56 serves as a stop to limit the travel distance of flange 58 in groove 56 thereby also limiting the distance which first end 52 of each extendable arm 14*a*, 14*b*, 14*c*, and 14*d*, may be extended beyond ends 50*a* and 50*b* of second plate 12. Groove 56 and flange 58 assemblies also prevents arms 14*a*, 14*b*, 14*c*, and 14*d* from being removed or accidentally falling from said second plate. End 52 of each extendable arm 14*a*, 14*b*, 14*c*, and 14*d*, is hook shaped so as to engage horizontal coated wire members of an automatic dishwasher.

Figure 5:
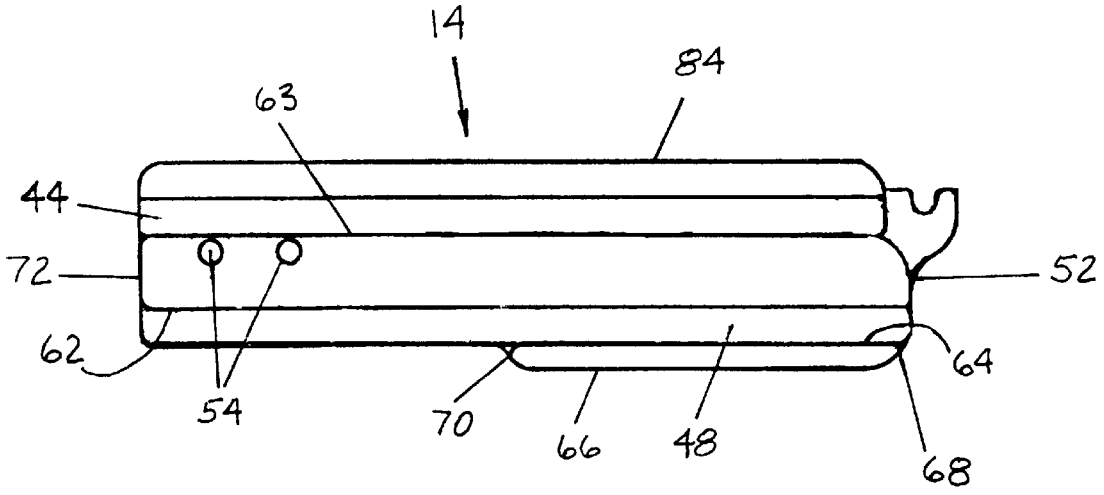
FIG. 5 is an orthogonal view of an inwardly facing side of an extendable arm of the present invention.

Now referring to FIGS. 4, 5, and 7, respective sides 46*a* and 46*b* of first plate 10 are mounted and slide within respective channels 48 of each extendable arm 14*a*, 14*b*, 14*c*, and 14*d*. First side wall 62 of first channel 48 is defined as the side closest to second channel 44 of each extendable arm 14*a*, 14*b*, 14*c*, and 14*d*. Second side wall 64 of first channel 48 is the side farthest from second channel 44 and closest to the long edge 66 of each extendable arm. First sidewall 62 extends the length of each extendable arm 14*a*, 14*b*, 14*c*, and 14*d*, but second sidewall 64 does not. First end 68 of second side wall 64 of first channel 48 of each extendable arm 14*a*, 14*b*, 14*c*, and 14*d* begins at first end 52 of each extendable arm 14*a*, 14*b*, 14*c*, and 14*d*, while second end 70 of second side 64 terminates approximately two and a half inches from second end 72 of the arms. When extendable arms 14*a*, 14*b*, 14*c*, and 14*d* are all extended to overhang ends 50 of second plate 12 by the maximum achievable amount, second ends 70 of second side wall 64 of extendable arm's first channels 48 are positioned outwardly from ends 50*a* and 50*b* of second plate 12. When second plate 12 is lowered down over first plate 10, second ends 70 of second side walls 64 of first channel 48 of each extendable arms 14*a*, 14*b*, 14*c*, and 14*d*, passes vertically by first plate 10 until first side walls 62 of first channel 48 of each extendable arms 14*a*, 14*b*, 14*c*, and 14*d*, contacts the upwardly facing second face 76 of first plate 10. When the extendable arms 14*a*, 14*b*, 14*c*, and 14*d*, are slid inwardly, thereby reducing the distance to which the extendable arms 14*a*, 14*b*, 14*c*, and 14*d*, overhang ends 74*a*, 74*b*, and 50*a*, 50*b* of first and second plates 10 and 12 respectively, second end 70 of second side wall 64 of first channel 48 of each extendable arms 14*a*, 14*b*, 14*c*, and 14*d*, passes below first surface 20 of first plate 10. First plate 10 is thereby retained between the first and second side walls 62 and 64 of channel 48 of each extendable arm.

In addition to serving as extendable support arms and as latching means to hold first and second plates 10 and 12 together, extendable arms 14*a*, 14*b*, 14*c*, and 14*d*, also serve to stiffen the device for greater load carrying capacity. When the device is loaded with cups C and placed into a residential style dishwasher, second plate 12 is on the bottom and thereby directly receives the greatest share of load presented by the cups. Second plate 12 alone, if too thin, will deflect due to bending stresses caused by the weight of cups C. The vertical orientation of the extendable arms 14*a*, 14*b*, 14*c*, and 14*d* provides a more efficient section for resisting the bending stresses that occur when the device is loaded with cups. In the preferred embodiment, a thermosetting plastic is used for the making of first and second plates 10 and 12, and due to the heat of most dishwashers, the device's material tends to relax a bit, and thus the device deflects slightly at the mid span of the plates 10 and 12 during use. This does not harm the function of the cup holder of the invention. If the cup holder of the invention is extracted from the dishwasher during, or immediately following, the dishwashers final washing operation when the cup holder is still warm and is then held flat for about one minute until the plastic cools, the device will retain its original flat, or planer condition.

Referring to FIG. 4, at mid length of both plate 10 and 12, the plate member's sides 46*a*, 46*b* and 42*a*, 42*b* are indented slightly. Indention's 88*a*, 88*b*, and 90*a*, 90*b* are provided in the preferred embodiment to avoid interference with a water dispersing shaft or formation located at the center of the racks found in several residential style automatic dishwashers. This feature allows maximum sizing of the plates 10 and 12 for holding the maximum quantity of cups. Without this feature, the width of plates 10 and 12 along their entire length would necessarily have to be reduced just to avoid the water-dispersing shaft. The preferred embodiment is sized such that two devices will simultaneously fit in both the upper and lower racks of most residential style dishwashers with the water dispersing shaft somewhat encompassed by indention's 88 and 90 in sides 46*a*, 46*b* and 42*a*, 42*b* of first and second plates 10 and 12.

To use the current invention, the small diameter bottoms of tapered or conical shaped cups C which are to be washed are set into apertures 16 located in first plate 10, while first plate 10 is horizontally supported by its four short legs 18. The larger diameter open tops of the cups C project above the upwardly facing, second surface 76 of first plate 10. The perimeter of apertures 16 in first plate 10 prevent lateral movement of the cups in the plane of first plate 10. After the cups to be washed are positioned in apertures 16 of first plate 10, second plate 12 is set down over the open ends of the cups and latched to first plate 10. Apertures 78 in second plate 12 are sized and located such that cups C can not pass therethrough when the cup holder is inverted when mounted within an automatic dishwasher. Once second plate 12 is latched to first plate 10, cups C are securely trapped in apertures 16 of first plate 10.

Prior to setting second plate 12 over first plate 10, extendable arms 14*a*, 14*b*, 14*c*, and 14*d*, which are attached to second plate 12, are slid outwardly so that they maximally overhang ends 50 of second plate 12. Second plate 12 is then lowered until the four guideposts 36, which project from first face 38 of second plate 12, each enter designated apertures 41 in first plate 10. Designated apertures 41 are sized to receive first ends 80 of guideposts 36. Second plate 12 will come to rest when first side wall 62 of the first channel 48 in each extendable arm 14*a*, 14*b*, 14*c*, and 14*d* comes in contact with upwardly facing second face 76 of first plate 10. The spacing between second channel 44 and first channel 48 in each extendable arm 14*a*, 14*b*, 14*c*, and 14*d* of the preferred embodiment is such that second plate 12 will come to rest above first plate 10 prior to contacting the open tops of even the tallest known commercially available communion cups C. The preferred embodiment of the present invention is useful for washing any tapered cup having a bottom diameter smaller than the cup receiving apertures 16 in first plate 10 and a top, or open end diameter, larger than the cup C receiving apertures 16 and an overall height taller than the spaced distance between latched together first and second plate 10 and 12. To latch plate 10 and 12 together, the extendable arms 14*a*, 14*b*, 14*c*, and 14*d*, are slid inwardly, thereby reducing the distance that the extendable arms overhang ends 74 and 50 of plates 10 and 12. As extendable arms 14*a*, 14*b*, 14*c*, and 14*d* move inward, second side walls 64 of first channel 48 of the extendable arms slide beneath first surface 20 of first plate 10, thereby capturing edge 46*a* and 46*b* of first plate 10 in first channel 48.

Once plates 10 and 12 are latched together, extendable arms 14*a*, 14*b*, 14*c*, and 14*d* prevent relative lateral movement of plates 10 and 12 in a direction perpendicular to the vertical sides 46*a*, 46*b*, and 42*a*, 42*b* of plate 10 and 12. Guideposts 36, which are fixed to second plate 12 and whose projected ends 80 are surrounded by the sides of designated apertures 41 in first plate member 10, prevent undesirable relative lateral movement of two plates 10 and 12 in any direction. When first and second plates 10 and 12 are latched together, cups C are restricted from movement in all directions and are oriented similarly with the open ends of cups C adjacent to, but not necessarily touching, first surface 38 of second plate 12.

First and second plates 10 and 12 are sized such that two complete devices of the current invention will fit into a standard sized silverware tray, designed for holding forks, knives, and spoons in an institutional style dishwasher such as that typically used in restaurants and which is also used in the kitchens of many churches. Devices of the current invention, loaded with communion cups, are simply laid into these silverware trays with second plate 12 on the bottom. Legs 18 of first plate 10 and the bottoms of cups C will be projecting upward. The open ends of cups C and second surface 82 of second plate 12 will be facing downward. Cups C will be resting on the grid work of material, which defines second plate 12. Before the current invention is set into the silverware tray of an institutional type dishwasher, extendable arms 14*a*, 14*b*, 14*c*, and 14*d* are slid to the fully retracted position such that there is little or no portion of the arms overhanging ends 74*a*, 74*b*, and 50*a*, 50*b* of plates 10 and 12. When the device is set into the silverware tray, the only parts of the device which contact the silverware tray are edges 84 of each extendable arms 14*a*, 14*b*, 14*c*, and 14*d* closest to second channel 44 in the extendable arms.

Commercially available dishwashers designed for residential use contain racks that are less standard in size and shape than the previously referenced silverware trays used in institutional style dishwashers. Residential style dishwashers typically have coated wire racks having multiple upstanding wire formations throughout the racks designed to orient and help keep stable many types of utensils. Because the coating on the wire racks protect the utensils from being scratched by the wire and also protects the wire from the caustic dishwasher environment, reasonable care must be taken to avoid damage to the wire's coating. Therefore, to prevent haphazard bearing of the current device at unpredictable points on the dishwasher's rack, extendable support arms 14 retained at each corner of the preferred embodiment of the current device are provided to facilitate suspension of the device above the dishwasher rack's multiple upstanding coated wire formations. Cup holders 9 of the present invention are also mountable within residential dishwashers such that legs 18 of first plate 10 and the bottom of cups C project upward and the open ends of cups C project downward.

Referring now to FIGS. 1, 4 and 6, to facilitate stacking multiple devices of the current invention for storage, cavities 86 in second surface 82 of second plate 12 are provided which are sized and located to receive first ends 30 of four legs 18 of first plate 10. As one device is set on top of another, first end 30 of legs 18 of upper device fit into cavities 86 that are formed in second surface 82 of second plate 12 of the lower device.

Referring now to FIG. 2, in the preferred embodiment, first ends 30 of legs 18 are heads 28 of screws 22 and the adjacent portion is a washer 24 which serves as a flange having a diameter greater than that of screw head 28 and greater than that of the cavity 86 in second plate 12 into which screw head 28 will fit when multiple devices are stacked. The size of the leg receiving apertures 86 in second plate 12 are only large enough to receive screw heads 28 of the legs. This feature insures that the legs' entire length will not be able to pass through the second perforated plate member 12. Limiting the amount of leg penetration into second plate 12 insures that the bottoms of cups C held by the upper device do not contact second plate 12 of the lower device. Plastic tubing is cut to short lengths for use as standoffs 26 to cover the screw threads and to hold washers 24 firmly against the underside of screw heads 28.

Although the current invention evolved especially for the washing of communion cups, which are small and limited in variation from one manufacturer to another, the same concept can be used for the washing and storage of larger cups which are tapered in similar fashion to the communion cups described above. To carry larger and heavier cups, cup receiving perforations 16 in the first perforated plate member 10 need to be sized accordingly. Also, the length of each leg 18 of first plate 10 may need to be longer to prevent the bottoms of larger cups C from touching the tabletop or other support surface. And finally, the thickness of first and second plates 10 and 12 is determined by the size, weight, and spacing of cups C to be carried. Given a particular cup size and weight, greater spacing between cups C will permit plates 10 and 12 to be thinner because a greater surface area of material can remain between the apertures 16 and 78 which adds to the plate members' strength and stiffness. However, to carry the greatest quantity of cups, the required thickness of plates 10 and 12 needs to increase with the size and weight of cups to be supported.

Set forth in the preferred embodiment of the current invention are first and second plates 10 and 12 cut from plastic sheet material. This method of making these two parts was chosen because of the economy such a method facilitates when producing the device in small quantities. However, first and second plates 10 and 12 could also be made of welded and coated wire similar to the racks used in many dishwashers or they could be molded of a suitable plastic material. The perimeters of the cup receiving apertures 16 in first plate member 10 can be non-circular to fit cups having non-circular cross sections. Molded parts would provide the greatest economy for larger production quantities. Also, molding will allow first plate 10 and each leg 18 of first plate 10 to be combined into one item, thus eliminating the step of attaching the separate pieces together. Another alternate embodiment of the current invention would include a hinged connection between the two plates 10 and 12.

The preferred embodiment of this device uses extendable arms 14*a*, 14*b*, 14*c*, and 14*d* at both ends; however, another embodiment of the invention comprises longer extendable arms only at one end to provide the required adjustability, provided a means is also provided at the opposite end to mount the device to a dishwasher rack. Additionally, the preferred embodiment provides four guideposts 36, one at each corner, but only one is required to prevent relative lateral movement along a single path between plates 10 and 12. Also, each extendable arm 14*a*, 14*b*, 14*c*, and 14*d* of the preferred embodiment uses two retainer pins 54 to travel in narrow grooves 56 in second plate 12; however, only one retainer pin 54 is sufficient to prevent detachment of an extendable arm 14*a*, 14*b*, 14*c*, and 14*d* from second plate 12. Using two instead of one retainer pin 54 helps insure that each extendable arm 14*a*, 14*b*, 14*c*, and 14*d* remains more perfectly parallel with the sides of the second plate 12 as it is slid back and forth. Also, indention's 88*a*, 88*b*, and 90*a*, 90*b* are only required in one side of plates 10 and 12, although the preferred embodiment has them in both sides for simplicity of use.

Figure 8:
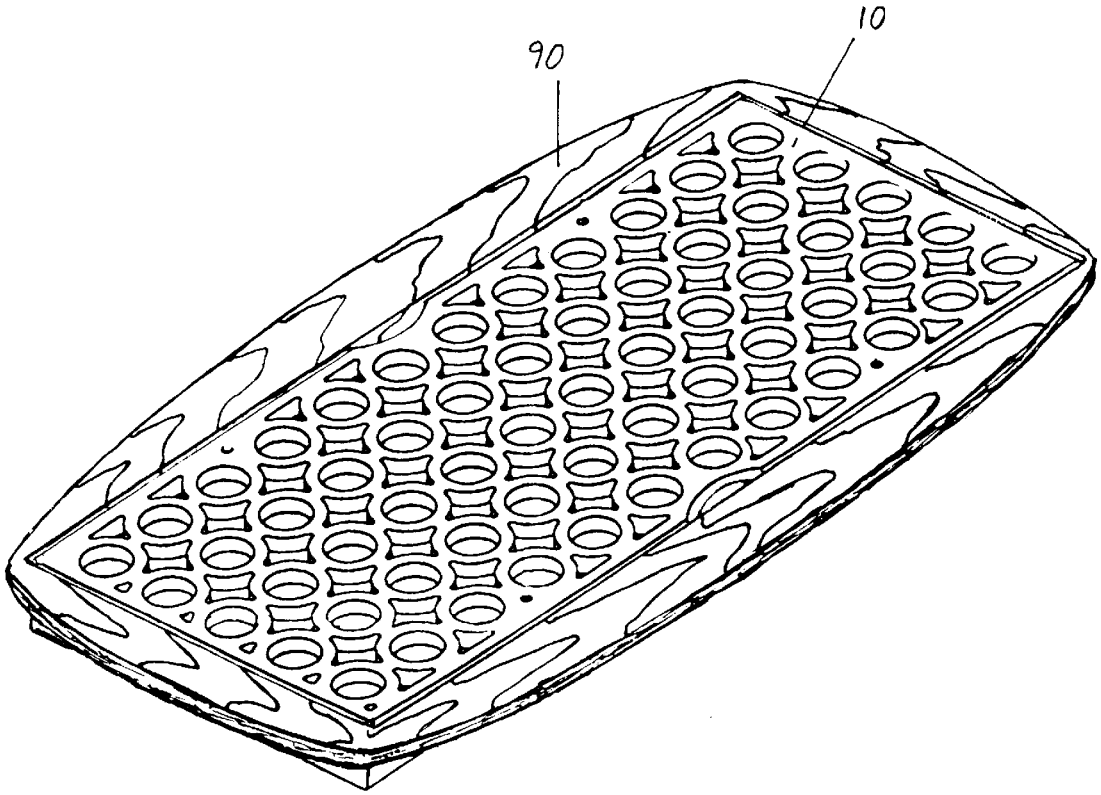
FIG. 8 is an isometric view of the cup holder of the invention mounted within a service tray.

Referring to FIG. 8, cup holder 9 of the invention is shown mounted within an attractive service tray 90, which can be made of wood or any other attractive material. Only first plate 10 with cups held within is then passed during communion.

While the invention has been described with reference to specific embodiments thereof, it will be appreciated that numerous variations, modifications, and embodiments are possible, and accordingly, all such variations, modifications, and embodiments are to be regarded within the spirit and scope of the invention.

What is claimed is:

1. A cup holder for use in an automatic dishwasher to hold tapered drinking cups having smaller diameters at the base than at the rim comprising;

a) a first, generally rectangular plate having a perimeter defined by two opposed sides, two opposed ends, and first and second opposed planar surfaces, and a plurality of apertures extending therethrough, said apertures being adapted to receive said base of said cups;

b) a second, generally rectangular plate having a perimeter defined by two opposed sides, two opposed ends, and first and second opposed planar surfaces, and having apertures extending therethrough, each said sides and said ends of said second plate being approximately the same length of the respective said sides and ends of said first plate;

c) at least two opposed extendable arms slideably attached to said cup holder and extendable beyond opposed ends of said first and second plates; and d) means for latching said first plate to said second plate to entrap cups therebetween.

2. The cup holder of claim 1, wherein means for latching said first plate to said second plate comprises first and second channels arranged parallel to each other and extending along length of the interior side wall of each said arm, wherein said first channel of each said arm receives therein a side of said first plate and said second channel of each said arm receives a corresponding side of said second plate.

3. The cup holder of claim 1, further comprising means for permanently and slideably attaching each said arm to said second plate said means comprising:

a) a groove formed within said first surface of said second plate and parallel to said sides thereof, wherein said groove is positioned adjacent one of said opposed ends of said second plate; and b) a flange formed extending from the inside wall of said arm, said flange is mounted within and slidable along said groove.

4. The cup holder of claim 3, wherein a stop is associated with said groove for stopping said flange, thereby preventing said arm from extending beyond its extreme extended position.

5. The cup holder of claim 1, wherein said extendable arms are formed to mount on horizontal bars in said automatic dishwasher, said bars being generally parallel with said ends of said second plate.

6. The cup holder of claim 1, wherein said first surface of said first plate includes a plurality of support legs extending therefrom.

7. The cup holder of claim 1 wherein said second surface of said second plate further comprises indention's adapted to receive said legs for purposes of stacking a plurality of said cup holders.

8. The cup holder of claim 1 further comprising indention's in at least one of said sides of said first and second plates, said indention's being formed to receive a generally vertical shaft found in said dishwasher.

9. The cup holder of claim 1 wherein said first and second plates are each comprised of a single sheet of material having generally uniform thickness throughout.

10. The cup holder of claim 1 further comprising at least one guidepost which projects from said first face of said second plate such that said at least one guidepost enters said one of said apertures of said first plate, thereby limiting movement of said first and second plates within their respective planes.

11. The cup holder of claim 1, wherein four opposed extendable arms are slideably attached to said cup holder and extendable beyond opposed ends of said first and second plates.

12. The cup holder of claim 10, wherein means for latching said first plate to said second plate comprises first and second channels arranged parallel to each other and extending along length of the interior side wall of each said arm, wherein said first channel of each said arm receives therein a side of said first plate and said second channel of each said arm receives a corresponding side of said second plate.

13. The cup holder of claim 1, wherein said cup holder is mounted within an attractive service tray.

* * * * *